United States Patent [19]

Sanchez, Jr.

[11] Patent Number: 4,648,674

[45] Date of Patent: Mar. 10, 1987

[54] IN-LINE FUSEHOLDER

[75] Inventor: Joseph J. Sanchez, Jr., Elgin, Ill.

[73] Assignee: Allied Corporation, Morris Township, Morris County, N.J.

[21] Appl. No.: 749,970

[22] Filed: Jul. 1, 1985

[51] Int. Cl.[4] ..... H01R 4/24

[52] U.S. Cl. ..... 339/97 P; 339/147 R

[58] Field of Search ..... 339/97 R, 97 P, 98, 339/99 R, 147 R, 147 P

[56] References Cited

U.S. PATENT DOCUMENTS

| | | | |
|---|---|---|---|
| 3,836,944 | 9/1974 | Lawson | 339/99 R |
| 3,865,460 | 2/1975 | Cherney et al. | 339/98 |
| 4,256,360 | 3/1981 | Debaigt | 339/97 R |
| 4,333,701 | 6/1982 | Schick | 339/97 P |
| 4,418,978 | 12/1983 | Shamir | 339/99 R |
| 4,441,778 | 4/1984 | Sampson | 339/99 R |
| 4,533,197 | 8/1985 | Prince et al. | 339/97 R |

*Primary Examiner*—Joseph H. McGlynn

*Attorney, Agent, or Firm*—Anibal Jose Cortina

[57] ABSTRACT

The invention relates to an in-line fuseholder which comprises a unitary housing with a cover integral therewith. Two fuse clip insulation displacement contact assemblies are press-fit into the housing. Wire securing mechanisms are provided to facilitate a one-step connection with wires from the exterior. After being closed over the wires, the wire securing mechanisms hold the wires in the housing in a strain-relief fashion. The wire securing mechanisms are also integral with the housing.

11 Claims, 6 Drawing Figures

IN-LINE FUSEHOLDER

BACKGROUND OF THE INVENTION

This invention relates to a unitary in-line fuseholder having integral wire securing mechanisms for ensuring secure and strain-free electrical contact between conductive wires and electrical contacts in the fuseholder.

One prior art fuseholder is disclosed in U.S. Pat No. 2,816,193. The device disclosed therein consists of a housing having two openings for permitting passage of individual electrical conductors, respectively, through each opening into the housing. Inside the housing are two contact members which are V-shaped for having the conductors wedge into the V-portion thereof to establish electrical contact by piercing of the conductor insulation. A cap holds a fuse clip which connects to the contacts when secured to the housing. This assembly includes a number of disadvantages in that it is complicated in structure, difficult to assemble and when opened, allows a user to touch the conductor/contact connection thereby exposing the user to a risk of shock.

Another prior art fuseholder assembly is generally illustrated in U.S. Pat. No. 3,793,612 and is comprised of a body having an integrally formed unitary hinge portion. The body member includes a pair of slots for passing wires into the fuseholder. A conductive contact is brought down onto the wires to establish electrical contact. Like the above-discussed prior art, this device also includes disadvantages in that precise positioning of the wires is sometimes difficult to achieve and may require extensive manual manipulation. In addition, as above, a danger of accidental electrical shock exists.

U.S. Pat. No. 3,829,822 generally describes an insulation severing contact of the type wherein conductors are wedged into the slots of the contact for establishing electrical contact. The fuseholder of this invention employs a contact similar to that of U.S. Pat. No. 3,829,822, but the contact of the fuseholder of the invention also includes a number of features not taught in U.S. Pat. No. 3,829,822 which facilitate establishing of the electrical connection.

SUMMARY OF THE INVENTION

In one aspect the invention is a fuseholder assembly comprising a unitary housing for housing a fuse clip and an electrical contact assembly therein. The housing includes access passages permitting passing of electrical conductors into the interior thereof to establish electrical connection with the electrical contact assembly. A cover is integral with the unitary housing for closing-off access to the interior thereof.

Inside the housing is arranged the fuse clip assembly for holding a fuse therein and an electrical contact assembly in electrical connection with the fuse clip assembly for establishing electrical connection with electrical conductors passed into the housing. A wire securing mechanism is also integral with the housing and when actuated serves to establish the electrical connection between the electrical conductors and the electrical contact assembly. The connection is established, as a result of the structure of the wire securing arrangement, in a strain relief manner with respect to the conductors and in addition, the wire securing mechansim becomes locked in a closed position thereby closing-off access to the electrical connection in an insulative manner.

In a preferred embodiment the housing is a one-piece thermoplastic body with the cover and wire securing mechanism integral therewith. The housing can be manufactured by conventional manufacturing techniques as will be readily apparent to those of ordinary skill in the art. In this construction the contact assembly and fuse clip assembly can be two one-piece units which are simply press-fit into place in the housing during assembly thereof. The contact portion of the assembly can be of the insulation displacement contact type having a generally V-shaped top portion which extends downwardly into an elongate slot into which the conductor can be forced into for establishing electrical connection.

Among the advantages provided by the invention is that the fuseholder is simple in construction and can be quickly and reliably connected to the electrical conductors. After assembly, the fuseholder provides an insulative barrier preventing access to the contact/conductor connections thereby minimizing the risk of electrical shock. Since the fuseholder body is of one piece construction, it also provides advantages in that it is simple and inexpensive to manufacture.

Other features and attendant advantages of the invention will be more readily apparent as the same becomes better understood from the following detailed discussion made with reference to the accompanying drawings in which like reference numerals designate like parts throughout the drawings.

DETAILED DISCUSSION OF THE INVENTION

Figure 1:
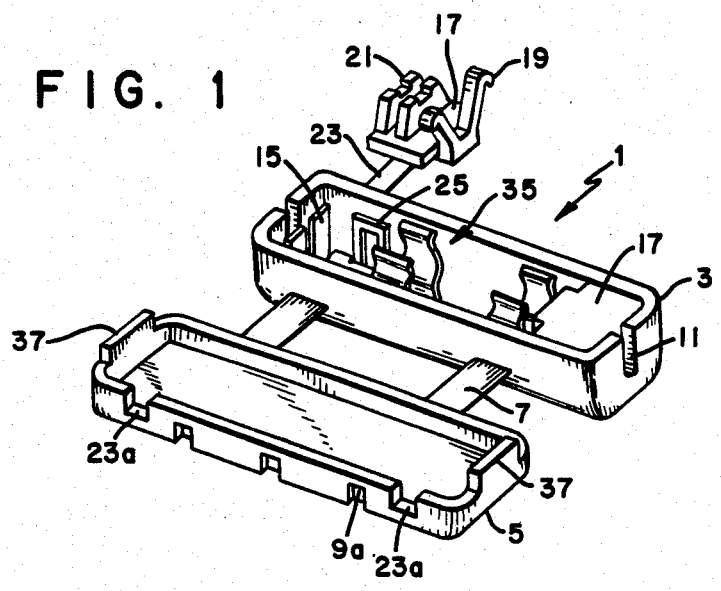
FIG. 1 is a perspective view of a fuseholder in accordance with the present invention, in open condition, with one of the wire securing mechanisms shown in locked closed position.
Figure 2:
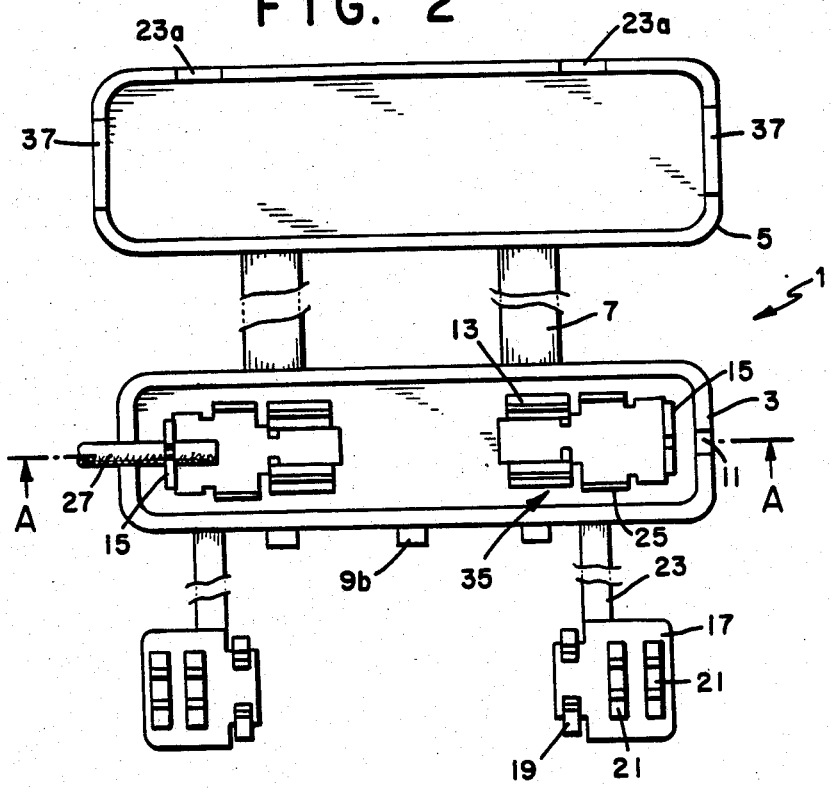
FIG. 2 is a top plan view of the fuseholder of FIG. 1 with both wire securing mechanisms in open position, and with an electrical conductor in position for establishing electrical connection with a contact of the device.
Figure 3:
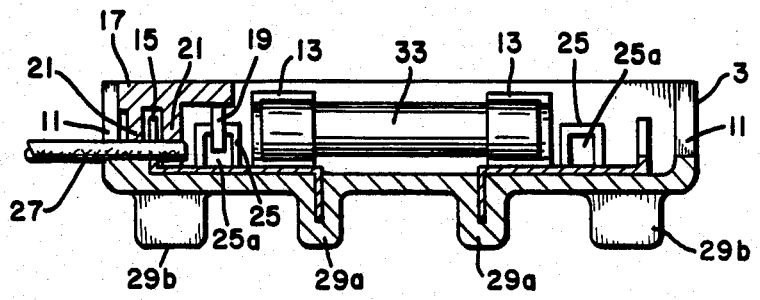
FIG. 3 is a cross-sectional view along line $\overline{AA}$ of the device of FIG. 2.

In FIG. 1 there is generally shown a fuseholder assembly 1 in accordance with the invention. As can be clearly seen, the fuseholder assembly 1 includes a main housing 3 having integrally connected thereto a cover 5 by means of flexible tab extensions 7. Wire securing mechanisms 17 are generally shown both in an open as well as a closed position. In the open position, the wire securing mechanism 17 shows locking legs 19, whose function will be described hereinafter, and strain relief projections 21, each of which includes a slight depression for permitting a wire conductor 27, as shown in FIGS. 2 and 3, to be compressed and held securely thereby. The housing 3 includes slots 11 at each end thereof for permitting wire conductors 27 to be passed into the housing 3. Once the wire conductors 27 are passed into the housing 3 for establishing electrical contact, each wire securing mechanism 17 is closed down into the housing 3 by bending of respective flexible tabs 23 which integrally connect the wire securing mechanisms 17 to the housing 3.

Figure 4A:
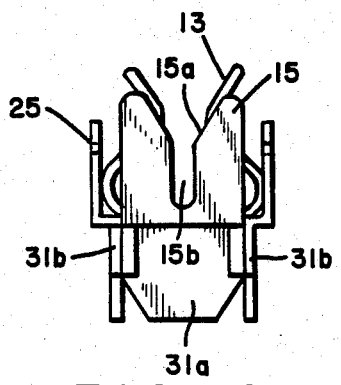
FIGS. 4*a* and 4*c* are, respectively, end and side views of the electrical contact/fuse-clip assembly of the invention.
Figure 4B:
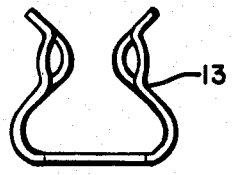
FIG. 4*b* is a partial view from one end of the electrical contact/fuse-clip assembly of the invention showing the fuse clip more clearly.
Figure 4C:
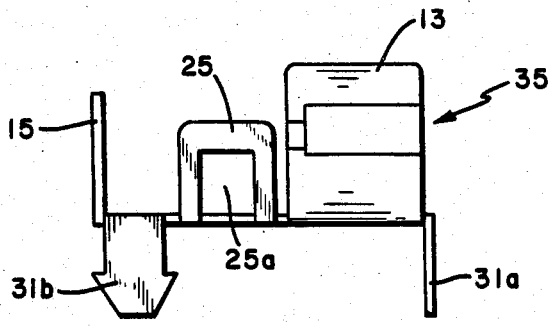

As more clearly shown in FIGS. 3–4c, wire contact-/fuse clip assembly 35 is secured within the housing 3 proximate each end thereof. As shown in FIGS. 4a and 4c, the assembly 35 includes downward projections 31a and 31b which respectively fit into molded receiving means 29a and 29b in the housing 3 shown in FIG. 3. These projections 31a and 31b generally wedge into the receiving openings 29a and 29b to be held securely in a press-fit fashion therein to facilitate insertion and removal of a fuse 33 into the fuse-clip portion 13 of each assembly 35.

In addition to the fuse clip holder 13, the assembly 35 also includes an insulation displacement contact 15, (hereinafter IDC), for establishing electrical connection with the wire 27, generally shown in FIGS. 2 and 3. The IDC 15 includes a generally V-shaped cutout 15a at the top portion thereof which extends downwardly into an elongate slot 15b, and which has a width sufficiently smaller than the diameter of the wire 27 to be connected thereto so as to displace or cut the insulative covering of the wire 27 and establish electrical contact between the conductors in the wire 27 and the IDC 15. For this purpose, the wire-securing mechanism 17 also includes the wire holding means 21 which straddles the IDC 15, and which serves generally to force the wire 27 downwardly into the slot 15b after being initially located in region 15a, thereby establishing the electrical connection with IDC 15. Thus, the electrical connection in-line of the assembly of the invention is greatly facilitated and does not require extensive alignment and connecting steps.

In addition to the IDC 15 and the fuse clip holder 13, the contact/fuse-clip assembly 35 also includes locking means 25 for the wire securing mechanism 17. As can be seen from FIG. 4, the locking means 25 is generally a vertically extending plate or flange 25 having an opening 25a. When the wire securing mechanism 17 is folded over to engage the wire 27 and connect it to the contact 15 and thereby close off access to the connection in an insulative manner, projections 19 of the wire securing mechanism 17 engage within opening 25a of plate or flange 25 to be thereby locked into a closed position.

Once the connection with the wires 27 is made at each end of the fuseholder assembly 1, the housing 3 is closed by cap 5, and cap 5 is locked in a closed position by engagement between recesses 9a and projections 9b as shown generally in FIGS. 1 and 2. Slots 23a are also provided on the housing 3 to allow for passage of the flexible tabs 23 of the wire securing mechanisms 17 into the housing of the fuseholder when the wire securing mechanisms 17 are locked in a closed position.

As can be also seen from FIGS. 1 and 2, the cover 5 will also include downward projections 37 which close-off most of the access to the interior of the body of the fuseholder assembly 1 through slots 11. More particularly, only an opening sufficiently large to permit the wires 27 to pass into each end of the fuseholder assembly is left and access from the exterior by any other means is precluded by projections 37. Thus, the probability of inadvertent shock by inserting some object other than the wires 27 is substantially eliminated.

As noted previously, the housing 3 and cover 5 of the fuseholder assembly are made preferably of a thermoplastic material which can be injection molded or manufactured by other similar conventional techniques as will be readily apparent to those of ordinary skill in the art. The materials employed are insulative in nature to prevent electrical shorting between the two assemblies 35. As such, the only conductive path will be between the conductors 27 through the fuse 33. With respect to the materials used to manufacture the assemblies 35, these are conventional materials of a conductive nature and the assemblies 35 are made by conventional stamping and/or other conventional manufacturing processes as presently in use in the manufacture of such assemblies as will also be readily apparent to those of ordinary skill in the art.

In this regard, it is preferred that the housing 3, cover 5 and wire securing mechanism 17 be made of injection molded polypropylene such as that identified and commercially available from A. Schulman Company under the designation RPP1174. Alternative materials include polypropylene available from Monmouth Plastics under the designation PP301 or nylon available from Dupont under the designation FR10.

With respect to the contacts/fuse clip assemblies 35, they are preferably made of steel available, for example, under the designation of 1010 full hard C.R. steel. Alternative materials include Phosphor Bronze alloy 510, and CDA 260 Brass, both tempered to 6 numbers hard.

What is claimed is:

1. A fuseholder assembly comprising:

(a) unitary housing means for housing fuse clip means and electrical contact means therein, and said unitary housing means having access means for providing access to electrical conducting reans to the interior of said unitary housing means;

(b) cover means integral with said unitary housing means and constructed for closing-off access to the interior of said unitary housing means;

(c) electrical contact means disposed in said unitary housing means for being connected to electrical conducting means;

(d) fuse clip means disposed in said unitary housing means for holding fuse means therein, said fuse clip means being in electrical connection with said electrical contact means in a manner for establishing a conductive path through fuse means in electrical connection with said fuse clip means; and (e) separate wire securing means integral with said housing, movable from a first open position to a second closed and latched position for urging electrical conducting means into a position with respect to said electrical contact means for establishing electrical contact connection between said electrical conducting means and said electrical contact means in a strain relief manner with respect to said electrical conducting means, and for preventing access, in a secure and insulative manner, to said connection between said electrical conducting means and said electrical contact means whereby said cover means can be opened for changing fuse means without disrupting the electrical connection between said electrical contact means and electrical conducting means.

2. An assembly as in claim 1 wherein said unitary housing means is a one-piece molded unit made of insulative thermoplastic material.

3. An assembly as in claim 1 wherein said wire securing means comprises wire holding projections for compressively holding said electrical conducting means against said housing in strain relief fashion.

4. An assembly as in claim 1 wherein said cover means further comprises closing means for closing off substantially all access to the interior of said fuse-holder assembly when closed except for sufficient access to permit only said electrical conducting means to be passed into the interior of said assembly.

5. An assembly as in claim 1 wherein said unitary housing means, cover means and wire securing means are made of injection molded polypropylene.

6. An assembly as in claim 1 wherein said electrical contact means and fuse clip means are made of steel.

7. An assembly as in claim 1 wherein said electrical contact means and said fuse clip means are part of a single unit assembly which is press-fit in a secure manner into receiving means in said housing.

8. An assembly as in claim 7 wherein said electrical contact means is an insulation displacement contact.

9. An assembly as in claim 7 wherein said single unit assembly is made of conductive material.

10. An assembly as in claim 7 wherein said single unit assembly further comprises locking means for holding said wire securing insulating means in closed position when employed to secure a wire in strain relief manner in said fuseholder assembly.

11. An assembly as in claim 10 wherein said wire securing means is connected for being located within said unitary housing means in said second closed and latched position, and is independently operable from said cover means.

* * * * *